US010745962B2

(12) United States Patent
Mitchell

(10) Patent No.: US 10,745,962 B2
(45) Date of Patent: Aug. 18, 2020

(54) INTEGRALLY HINGED STILE

(71) Applicant: Arconic Technologies LLC

(72) Inventor: Michael D. Mitchell, Woodstock, GA (US)

(73) Assignee: Arconic Technologies LLC, Pittsburgh, PA (US)

( * ) Notice: Subject to any disclaimer, the term of this patent is extended or adjusted under 35 U.S.C. 154(b) by 165 days.

(21) Appl. No.: 15/907,396

(22) Filed: Feb. 28, 2018

(65) Prior Publication Data

US 2019/0264492 A1 Aug. 29, 2019

(51) Int. Cl.

| | |
|---|---|
| ***E06B 3/48*** | (2006.01) |
| ***E05D 7/00*** | (2006.01) |
| ***E06B 3/263*** | (2006.01) |
| ***E05D 11/00*** | (2006.01) |

(52) U.S. Cl.

CPC ..... *E06B 3/486* (2013.01); *E05D 7/009* (2013.01); *E05D 11/0054* (2013.01); *E06B 3/26303* (2013.01); *E06B 3/481* (2013.01); *E05Y 2900/132* (2013.01)

(58) Field of Classification Search

CPC ..... E06B 3/481; E05D 11/0054; E05D 3/122
See application file for complete search history.

(56) References Cited

U.S. PATENT DOCUMENTS 3,092,870 A * 6/1963 Baer ..... E05D 1/00 16/277
3,402,422 A * 9/1968 Baer ..... E05D 3/122 16/366
3,405,756 A * 10/1968 Harris ..... E06B 3/481 160/229.1
4,679,277 A * 7/1987 Shibata ..... E05D 3/122 16/354
4,765,027 A * 8/1988 Andric ..... E05D 3/122 16/354
4,953,261 A * 9/1990 Lyons ..... A47K 3/36 16/320
4,976,008 A * 12/1990 Baer ..... E05D 3/122 16/273
4,999,880 A * 3/1991 Baer ..... E05D 1/04 16/354
5,062,181 A * 11/1991 Bobrowski ..... E05D 3/122 16/234
5,337,451 A * 8/1994 Goossens ..... E05D 3/122 16/354
5,778,491 A * 7/1998 Baer ..... E05D 3/122 16/354

(Continued)

FOREIGN PATENT DOCUMENTS

CA 2505297 A1 * 10/2006 ..... E05D 11/0081
EP 0903460 A1 * 3/1999 ..... E05D 1/04

OTHER PUBLICATIONS

ISR/WO from PCT/US2019/019522 a continuation of U.S. Appl. No. 15/907,396 dated Jun. 10, 2019.

*Primary Examiner* — Marcus Menezes
(74) *Attorney, Agent, or Firm* — Vorys, Sater, Seymour and Pease LLP

(57) ABSTRACT

A hinge for a bi-fold door is integrated with a pair of stiles. Each stile has a hinge flange integrated to the stile. Opposing stiles with opposing and aligned hinge flanges collectively create an integral hinge assembly that may be useful in thermal doors employing one or more thermal breaks.

15 Claims, 8 Drawing Sheets

(56) References Cited

U.S. PATENT DOCUMENTS

| | | | | | |
|---|---|---|---|---|---|
| D411,434 | S * | 6/1999 | Russell | D8/323 | |
| 5,941,027 | A * | 8/1999 | Hallsten | E04H 4/082 | 16/354 |
| 6,694,568 | B2 * | 2/2004 | Baer | E05D 3/122 | 16/223 |
| 6,735,823 | B2 * | 5/2004 | Pelletier | E05D 3/122 | 16/251 |
| 8,496,042 | B1 * | 7/2013 | Motosko | E06B 9/0638 | 160/187 |
| 9,297,190 | B2 * | 3/2016 | Lee | E05D 3/122 | |
| 2006/0260768 | A1 * | 11/2006 | Svenson | E05D 1/04 | 160/235 |
| 2010/0024169 | A1 * | 2/2010 | Self | A47K 3/36 | 16/354 |
| 2015/0252601 | A1 * | 9/2015 | Alexander | E05D 3/122 | 49/386 |

* cited by examiner

INTEGRALLY HINGED STILE

BACKGROUND OF THE INVENTION

Field of the Invention

A hinge for doors, particularly for folding doors.

Background of the Invention

Folding doors are often used in spaces where doors are required but there is a desire, motivated either by space or aesthetics, to collapse the door. Folding doors are able to collapse into a smaller space due to hinges between sections of the door. The hinges are often located on a part of the door that is known as a stile.

Repeated engagement of the hinge mechanisms occurs when opening and closing folding doors; therefore, the hinges connecting the folding doors should be durable, strong, and maintain a solid connection with the door stiles. One way in which the door assembly may be made durable and strong is by extending the length of the hinge within the door (e.g., making the hinge flange larger). Another way in which the door assembly may be made durable and strong is by using a hinge that is made out of a heavy duty material. Typically, hinges for bi-folding aluminum doors are made from metal. However, aluminum, titanium, PVC, steel, fiberglass, an alloy, or some other metal may be used.

Sometimes, folding doors are used in entrances to separate the interior and the exterior of a building. In such circumstances, folding doors are manufactured to include a thermal break between interior and exterior panels of the door to prevent heat transfer across the door.

Designing efficient thermal breaks around assembly parts that are highly thermally conductive, such as aluminum hinge assemblies, is difficult. The most thermally efficient performance of a thermally broken door is achieved when all of the thermal breaks are in line within a single plane within the door. However, this ideal alignment of thermal breaks within a door may conflict with the installation of thermally conductive hinges. Thermally conductive hinges, when installed to the door stile, can form a bridge over the thermal break, thereby short circuiting the effectiveness of any included thermal break.

There is an ever-present drive to increase energy efficiency in building design, especially in structural members that link the exterior and the interior of the building. However, present designs are flawed as will be described in greater detail herein. Thus, there is a need to design a collapsible bi-fold door that reduces thermal conductivity across the door but also incorporates a durable and strong hinging mechanism.

SUMMARY OF THE INVENTION

A hinge for bi-fold doors of the present invention may be an integral part of a stile. The inventive stile allows for easy assembly of folding doors without compromising thermal breaks and/or other thermal separators.

One aspect of the present invention provides a hinged thermal folding door. In one embodiment, the thermal folding door has at least two door panels with a stile between said door panels, the stile comprising an integral hinge assembly and at least one thermal break. In a further embodiment, the integral hinge assembly has two opposing integral flanges integral to the stile. In a further embodiment of any of the foregoing embodiments, each flange further has a gear portion having cogs. In a further embodiment of any of the foregoing embodiments, integral flanges are oriented in the integral hinge assembly such that the arcs of the gears of each integral flange oppose each other.

In a yet another embodiment of any of the aforementioned embodiments, the door panel is integral to the stile with the integral flange.

Another aspect of the present invention provides a method for assembling the hinged thermal doors as described in any foregoing embodiment. In one embodiment, thermal folding doors may be assembled by aligning a first integral flange on one stile to a second integral flange on a second stile to align the cogs on each integral flange's gear such that when the hinge assembly is engaged and the integral flanges move about a pivot point, the cogs on the gear of one integral flange interlace with the cogs on the gear of the other integral flange. In a further embodiment, a recess in each integral flange is provided. Recesses may be provided by any number of methods. For example, in one embodiment, once the integral flanges are aligned, corresponding portions of each integral flange may be removed to create said recess in each integral flange. In a further embodiment, the recess may be created by milling. In an alternate embodiment, the stile with integral hinges may manufactured to include said recess. In another embodiment of any foregoing embodiment, said recesses may be aligned to create a space into which a knuckle may be placed. In some embodiments of any of the aforementioned embodiments, a gear cap may be slid over the aligned integral flanges and knuckle. In any one of the forgoing embodiments, the gear cap may be sized to cover the gear of each integral flange. In any of the foregoing embodiments, the gear cap may be held in place by securing the gear cap and the knuckle together. For example, this may be accomplished in some embodiments by screwing the knuckle and gear cap together.

In another aspect, the present invention provides a single panel of a thermal folding door having a flange integrated to the stile. In a further embodiment, the integral flange has a gear portion having cogs. In a further embodiment of any foregoing embodiments, the integral flange has at least one recess long the length of the integral flange. In a further embodiment, the stile contains at least one thermal break.

In any of the foregoing embodiments, stiles with integral flanges may be manufactured by extrusion. Alternatively, in any of the foregoing embodiments, stiles with integral flanges may be manufactured by pultrusion. In any of the foregoing embodiments, any material may be used to manufacture said stiles with integral flanges. For example, in any one of the foregoing one embodiments said material may be aluminum.

BRIEF DESCRIPTION OF THE DRAWINGS

Aspects, features, benefits, and advantages of the embodiments herein will be apparent with regard to the following description, appended claims, and accompanying drawings. In the following figures, like numerals represent like features in the various views. It is to be noted that features and components in these drawings, illustrating the views of embodiments of the presently disclosed invention, unless stated to be otherwise, are not necessarily drawn to scale.

DETAILED DESCRIPTION OF THE INVENTION

In the following description, the present invention is set forth in the context of various alternative embodiments and implementations involving an integral hinge assembly and its use in thermal hinged bi-folding doors. While the following description discloses numerous exemplary embodiments, the scope of the present patent application is not limited to the disclosed embodiments, but also encompasses combinations of the disclosed embodiments, as well as modifications to the disclosed embodiments as well as other embodiments.

Figure 1:
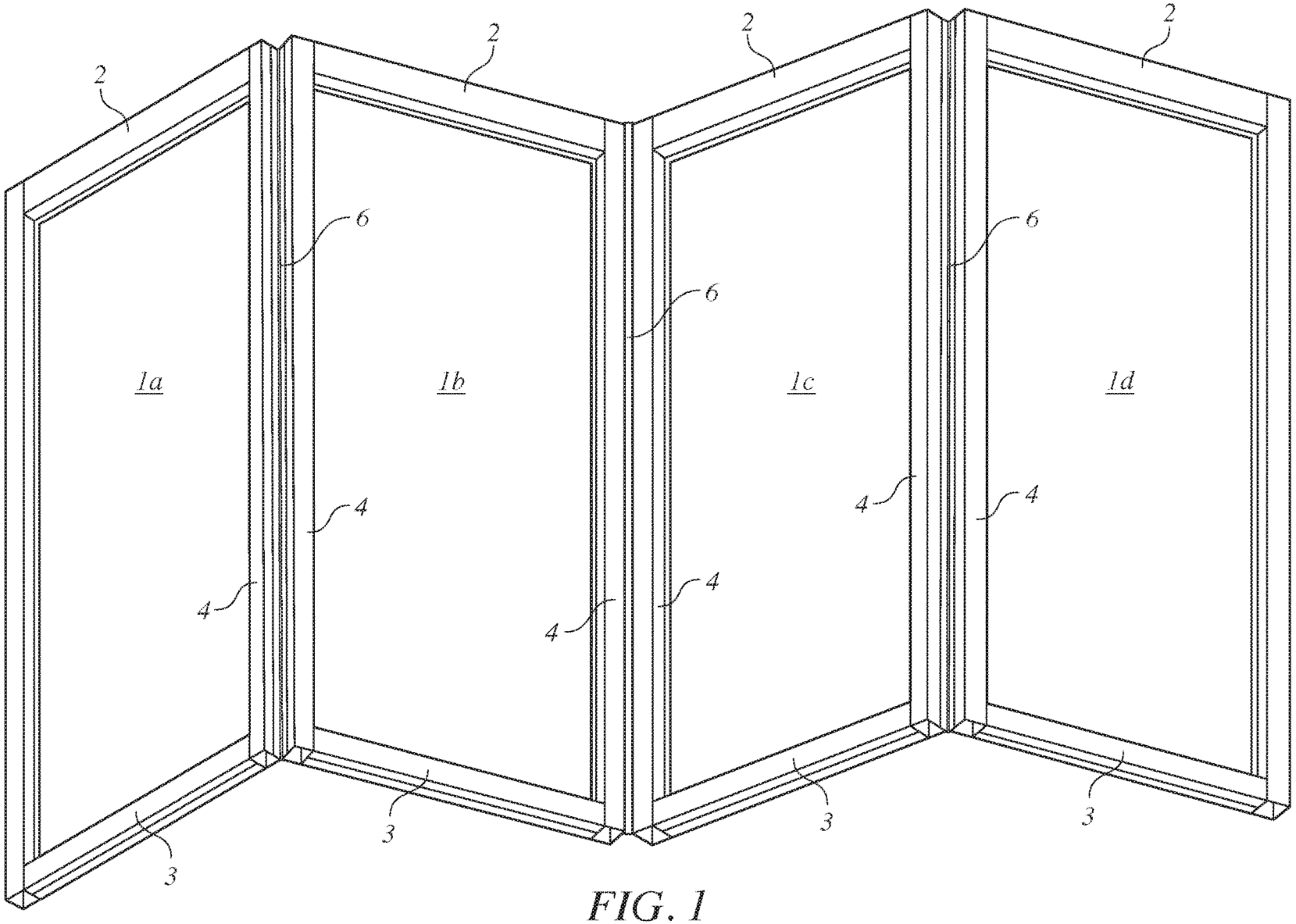
FIG. 1 depicts a bi-fold door employing the integral hinge assembly as described herein.

The present invention provides thermally efficient hinged bi-folding doors designed to overcome issues present in the prior art. One example of the application of integral hinged assemblies in thermally efficient hinged bi-folding doors as described herein is shown in FIG. 1. FIG. 1 displays four panels 1*a*, 1*b*, 1*c*, and 1*d*, each with a top rail 2, bottom rail 3, and stiles 4. Between each opposing stile 4 is a hinge assembly 6, each of which are integral hinge assemblies that substantially span the height of the door. Within each style 4, but not visible from this perspective, is a thermal break.

Figure 2:
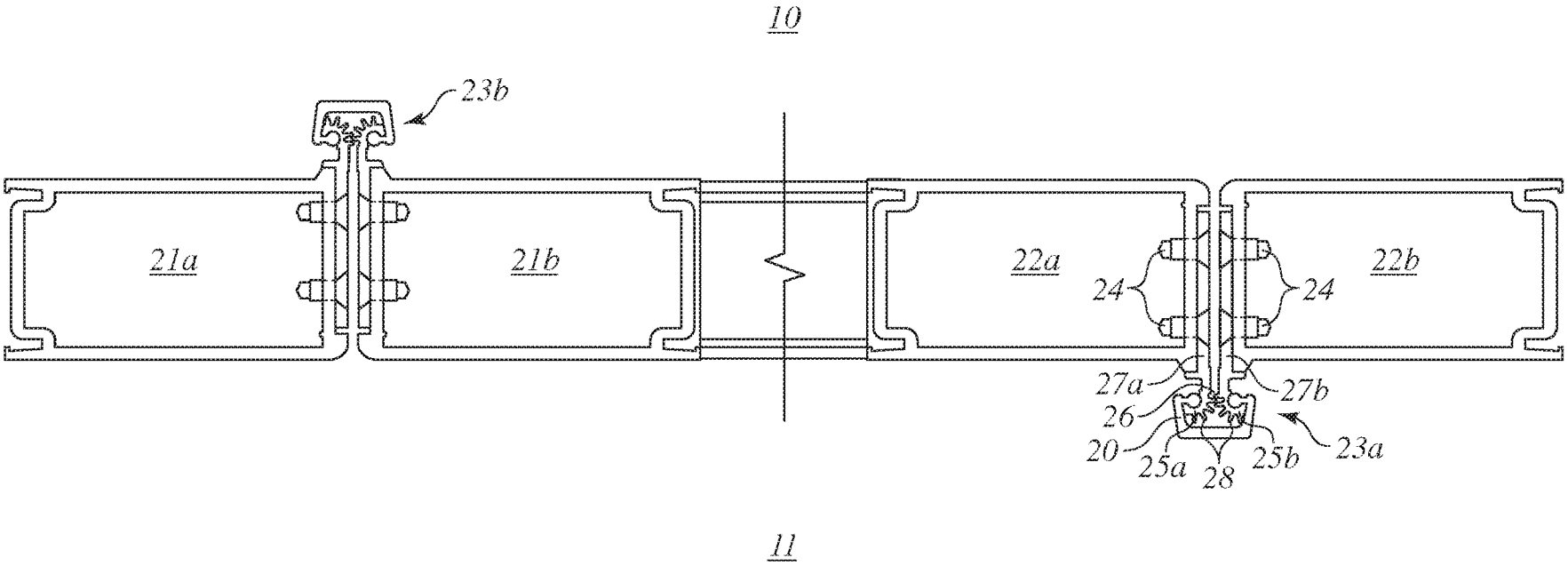
FIG. 2 (PRIOR ART)
FIG. 2 is view from above of a conventional bi-fold door employing conventional continuously geared hinging.

Prior art designs of hinged bi-folding doors are shown in FIGS. 2, 3*a*, 3*b*, and 4. FIG. 2 shows a detailed view of a conventional non-thermal bi-folding door as a cross-sectional view from above. The bi-folding door in FIG. 2 has interior side 10, exterior side 11, and stiles 21*a*, 21*b*, 22*a*, and 22*b*. The hinge assembly 23*b* between stiles 21*a* and 21*b* is oriented such that when the door opens, stiles 21*a* and 21*b* fold. Similarly, the hinge assembly 23*a* between stiles 22*a* and 22*b* is oriented such that when the door is opened, stiles 22*a* and 22*b* fold. Hinge 23*a* and hinge 23*b* are oriented on opposite sides of the stiles with respect to the interior side 10 and exterior side 11 and this alternating design is necessary to achieve a door with stiles that may be collapsed upon each other.

The hinge assembly 23*a* has two abutting flanges 27*a* and 27*b* each having a gear 25*a* and 25*b* and a pivoting point 26. Each flange is secured to its stile by screws 24. The gear 25*a* and 25*b* of each flange 27*a* and 27*b* has an arc. The two abutting flanges 27*a* and 27*b* are oriented such that the arc of gear 25*a* opposes the arc of gear 25*b* and when the hinge mechanism is engaging in opening the door, the abutting flanges 27*a* and 27*b* move about the pivot point 26. In the same motion, the cogs 28 from gear 25*a* will interlace with the cogs 28 from gear 25*b*. A gear cap 20 covers and holds in place the combined gears 25*a* and 25*b*. Notably, gears 25*a* and 25*b* are integral with flanges 27*a* and 27*b* and flanges 27*a* and 27*b* extend substantially across the depth of stiles 22*a* and 22*b*. Hinge assembly 23*a* is fastened to stiles 22*a* and 22*b* by fasteners, namely screws 24, and are not integral with stiles 22*a* and 22*b*. Within the context of the present invention, integral means that the named elements are made of one material, not detachable from each other, joined together without a fastener. Hinge assembly 23*b* displays similar characteristics as described above for hinge assembly 23*a*. As noted above, FIG. 2 depicts a conventional folding door but lacks any thermal breaks and thus is not a thermal door.

Figure 3A:
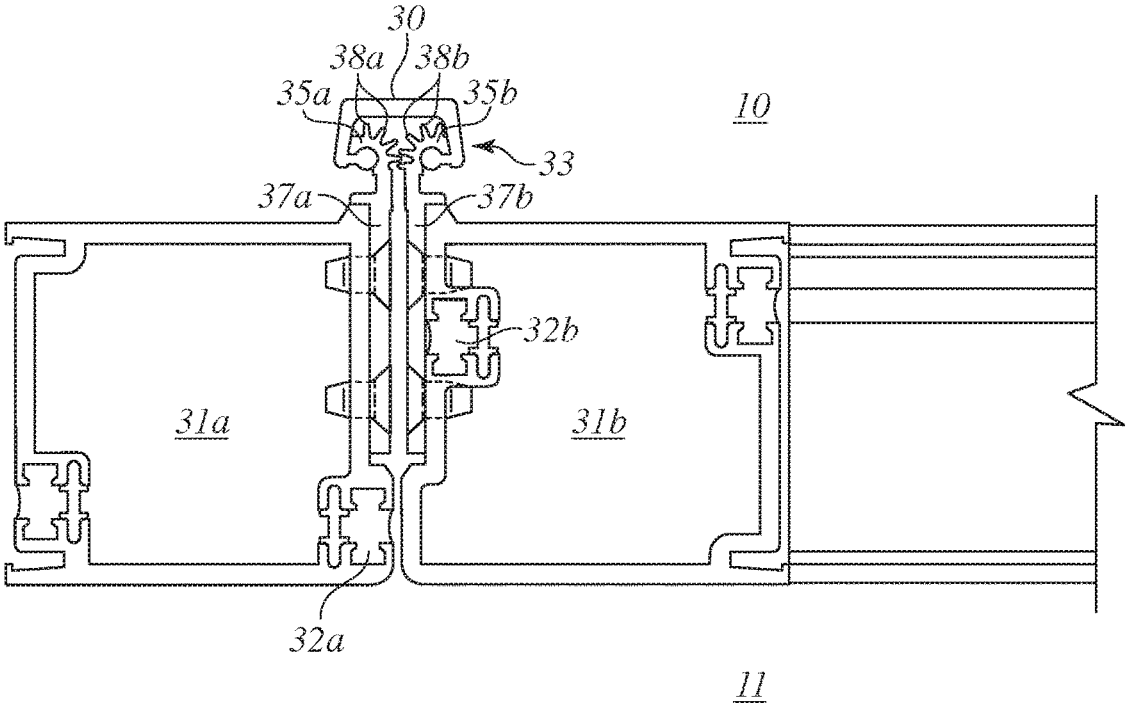
FIG. 3a (PRIOR ART)
FIG. 3*a* is a view from above of a section of a thermal bi-fold door illustrating the use of standard hinge assemblies which short circuits the thermal break and offsets the thermal break to the exterior to accommodate hinge flange.

FIG. 3*a* is a prior art example of a portion of a bi-folding door having stiles with thermal breaks and a hinge assembly made of a thermally conductive material (e.g., metal) fastened to the stile with screws, illustrating how a poorly placed thermal break may be bridged by a thermally conductive hinge flange. The bi-folding door in FIG. 3*a* is a cross-sectional view from above. The bi-folding door in FIG. 3*a* has an interior side 10, an exterior side 11, and a hinge assembly 33 on the interior side. In the same geometry as the hinge assembly shown in FIG. 2, flanges 37*a* and 37*b* have gears 35*a* and 35*b* which are oriented such that the cogs 38*a* on gear 35*a* will interlace with the cogs 38*b* on gear 35*b* when the door is opened. Flanges 37*a* and 37*b* are secured to stiles 31*a* and 31*b* using fasteners. Gear cap 30 secures the gears 35*a* and 35*b* together to create the functional hinge assembly.

Door stiles 31*a* and 31*b* have structure walls akin to those shown in FIG. 2, but additionally have thermal breaks 32*a* and 32*b*. Thermal break 32*a* was moved toward exterior 11 to avoid a thermal bridge through flange 37*a* of the hinge assembly 33; however flange 37*b* of the hinge assembly 33 still spans thermal break 32*b* causing thermal short circuiting. Further, thermal breaks 32*a* and 32*b* are not aligned in a single plane, which further reduces thermal efficiency. Thus, the door shown in FIG. 3*a*, while including thermal breaks, is not a thermal door as was intended since thermal break 32*b* is bridged by the conductive adjacent flange 37*b*, thus reducing the thermal efficiency of the door from what was intended.

Figure 3B:
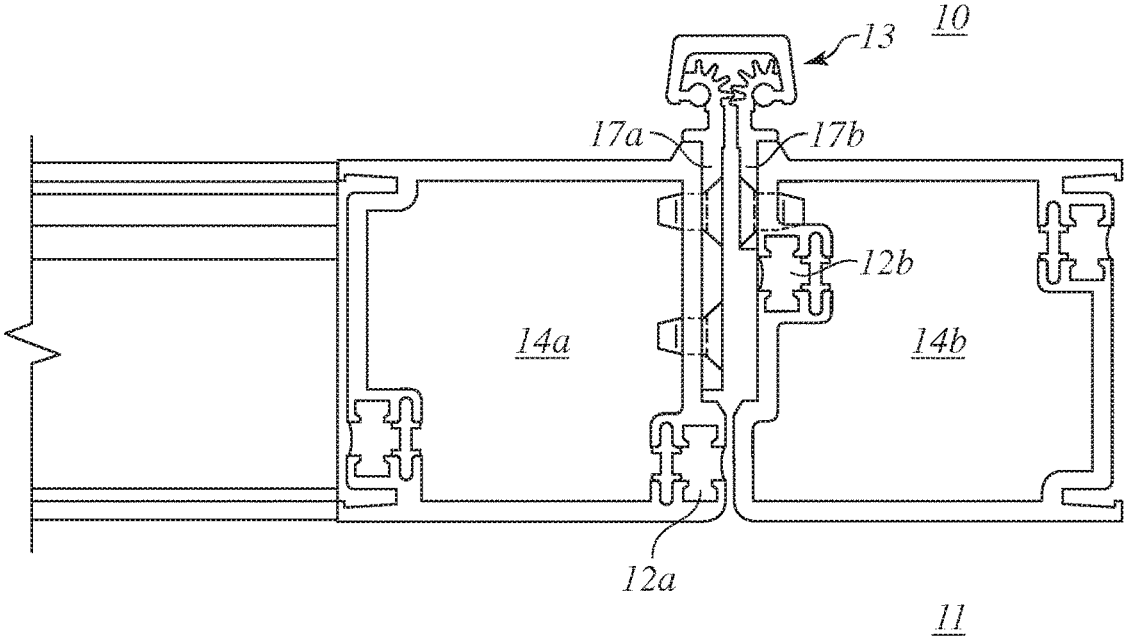
FIG. 3b (PRIOR ART)
FIG. 3*b* is a view from above of a section of a thermal bi-fold door illustrating the use of a substantially shortened hinge flange within a hinge assembly to accommodate thermal breaks.

FIG. 3*b* shows one solution to preventing a thermal bridge across a conductive hinge flange through another example of a section of a bi-folding door employing thermal breaks 12*a* and 12*b*. The door in FIG. 3*b* is a cross-sectional view from above. The bi-folding door in FIG. 3*b* has an interior side 10 and an exterior side 11, a hinge assembly 13 on the interior side of the door having hinge flanges 17*a* and 17*b*, which are secured to stiles 14*a* and 14*b* with fasteners. When compared to FIG. 3*a*, flange 17*b* has been shortened to avoid bridging thermal break 12*b*. However, the shortening of flange 12*b* weakens the hinge assembly 13 and the connection between door stiles 14*a* and 14*b* substantially. Further, as noted above, when designing a door with alternating hinges, the most thermally efficient performance is achieved when all thermal breaks are in line with each other with respect to the interior side or the exterior side. Notably, the thermal breaks in FIG. 3*b* are not aligned with each other. Thus, the door shown in FIG. 3*b*, while including thermal breaks, does not employ them with maximum efficiency and is further structurally weakened due to the shortened flange 17*b*.

Figure 4:
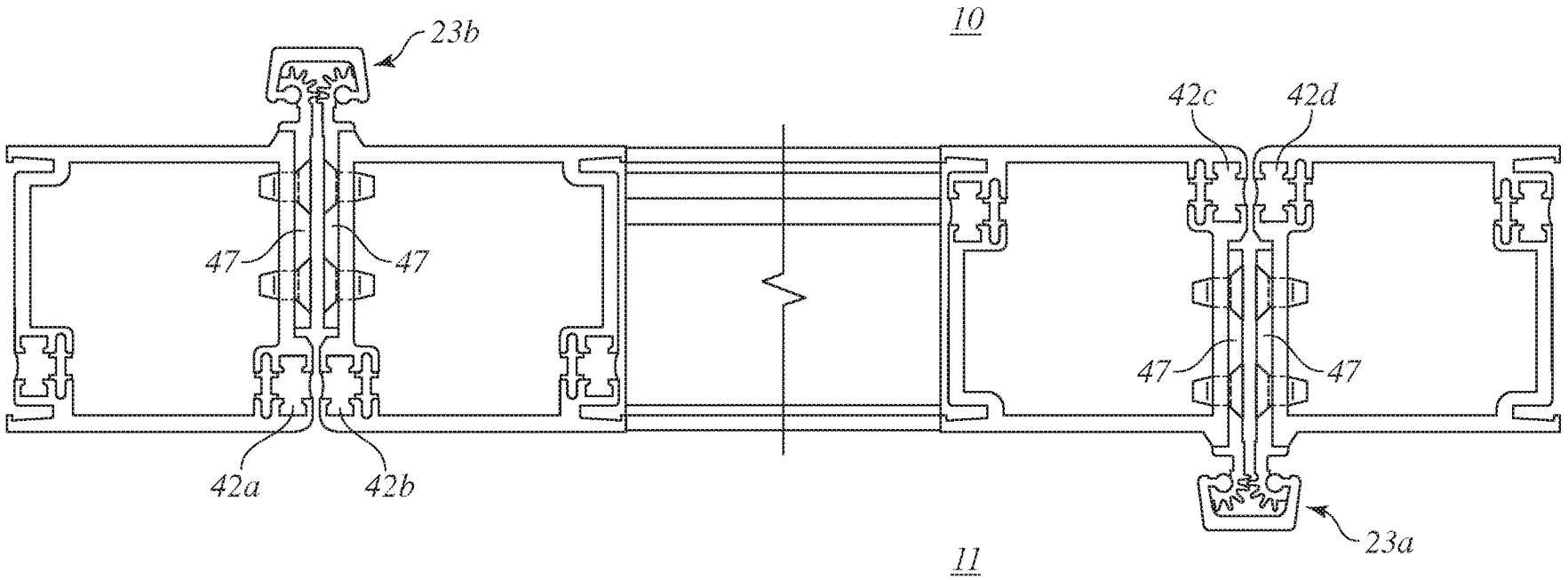
FIG. 4 (PRIOR ART)
FIG. 4 is a view from above of a thermal bi-fold door wherein the thermal breaks are inefficiently misaligned with respect to the exterior of the door.

FIG. 4 illustrates another alternative design to those shown in FIG. 3*a* and FIG. 3*b*, showing a bi-folding door similar to the one in FIG. 2, but employing thermal breaks 42*a*, 42*b*, 42*c*, and 42*d* and a hinge assemblies 23*a* and 23*b* having flanges 47 akin to flange 37*a* in FIG. 3*a*. Notably, in FIG. 4, thermal breaks 42*a* and 42*b* are positioned on the exterior side 11 of the door and 42*c* and 42*d* are positioned on the interior side 10 of the door, reducing efficiency of the incorporated thermal breaks (as they are not aligned). However, if thermal breaks 42*c* and 42*d* were moved to align them with thermal breaks 42*a* and 42*b*, a short circuit of thermal breaks 42*a* and/or 42*b* would occur such as illustrated in FIG. 3*a* because the flanges 47 of hinge assembly 23*a* or 23*b* would bridge either thermal breaks 42*a* and 42*b* or 42*c* and 42*d*. Thus, the door shown in FIG. 4 is not a thermal door that exhibits maximum thermal efficiency.

The present invention provides a solution to the many problems with current thermal door designs as described above.

In one aspect, the present invention provides a method for incorporating a strong, durable hinge mechanism into a bi-fold door assembly that that may accommodate a thermal break or other insert for enhancing thermal separation. This is achieved by integrating the hinge assembly to the door stile along the length of the door to provide an integral hinge assembly, as shown in FIG. 5.

Figure 5:
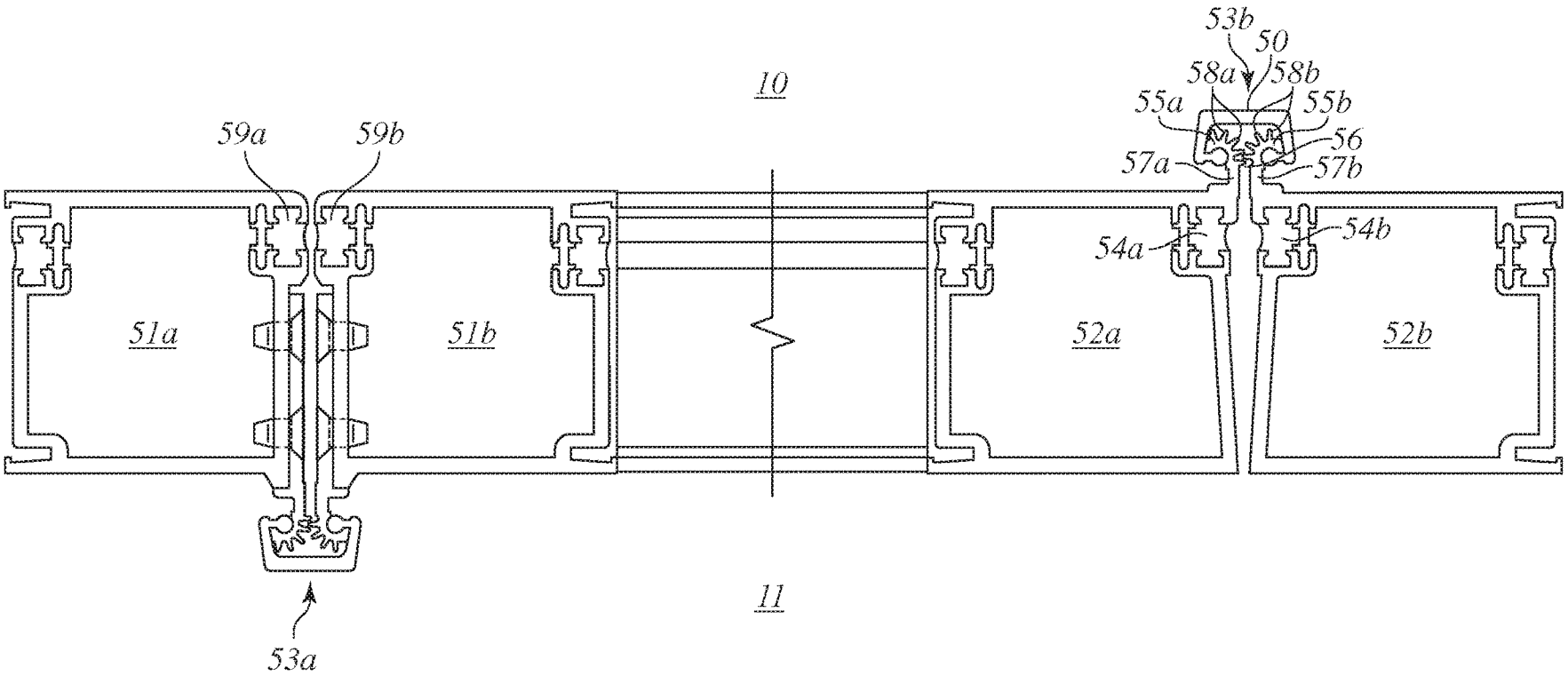
FIG. 5 shows a thermal bi-fold door employing an integral hinge assembly (e.g., has cogged gears integral to the stile) on the interior side of the door stile intended to enable folding of the stiles.

FIG. 5 illustrates one embodiment of the present invention. FIG. 5 shows a cross-section of a bi-fold door as viewed from above, having an interior side 10, an exterior side 11, and four stiles 51*a*, 51*b*, 52*a*, and 52*b*. The bi-fold door assembly also has alternating hinge assemblies 53*a* and 53*b*. Hinge assembly 53*a* is a conventional assembly such as is shown in FIG. 4 (and operates in the same fashion as discussed above) while hinge assembly 53*b* is an integral hinge assembly. Integral hinge assembly 53*b* has opposing integral flanges 57*a* and 57*b* each with gears 55*a* and 55*b* that are integral to the stiles and oriented such that the cogs 58*a* on gear 55*a* will interlace with the cogs 58*b* on gear 55*b* when the door is opened and the integral flanges 57*a* and 57*b* move about a pivoting point 56. The gears 55*a* and 55*b* are secured together by a gear cap 50. Stile 52*a* and 52*b* each have thermal breaks 54*a* and 54*b* that, due to the use of the integral hinge assembly 53*b*, align with the thermal breaks 59*a* and 59*b* in stiles 51*a* and 51*b*. As discussed previously, this alignment provides the optimum efficiency in reducing thermal conductance across the door assembly. Because the integral flanges 57*a* and 57*b* are integral to each door stile 52*a* and 52*b*, they do not span and short circuit the thermal breaks 54*a* and 54*b*, as was shown in hinge assembly 33 in FIG. 3*a*. Notably, integrating the flange to the stile also removes the need for screws to fasten the flange to the stile. Contrary to a conventional hinge assembly, wherein one or two hinge assemblies may be used along the height of adjacent door stiles creating only one or two points of connection between said door stiles, the integral hinge assembly may be substantially continuous along the height of each door stile to which it is integrated. Thus, through the increased interaction between gears of each flange in each integral hinge assembly, the integral hinge assembly is rendered durable further strengthening the connection between door stiles.

While FIG. 5 illustrates an embodiment where only alternating hinges on a collapsible bi-folding door are integral hinge assemblies, in some embodiments, all hinge assemblies on a thermal bi-folding door may be integral hinge assemblies.

Figure 6:
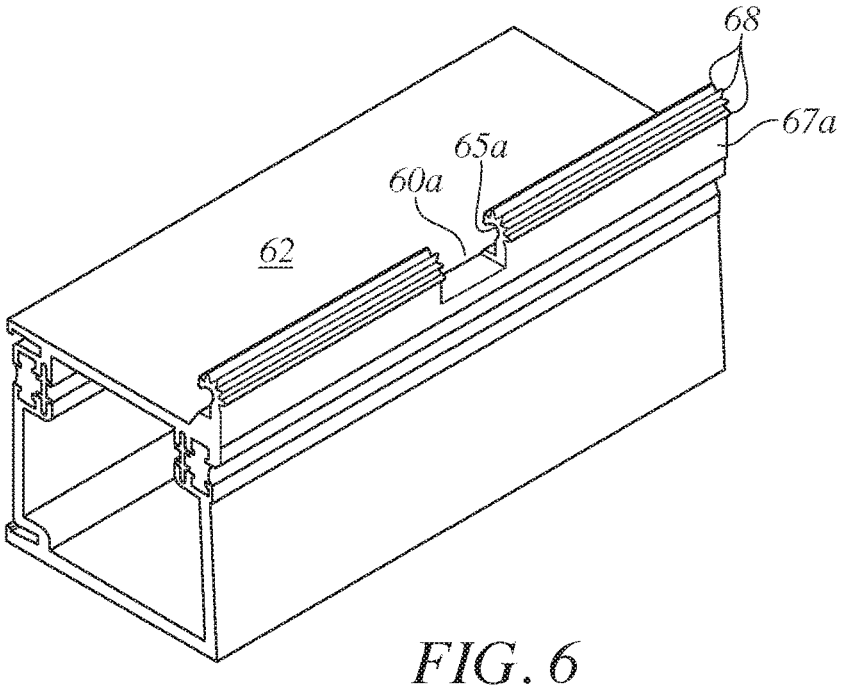
FIG. 6 illustrates a thermally broken stile with an integral flange, intended for use in an integral hinge assembly further displaying a recess in the integral flange.

A portion of one door stile that integrates one flange of an integral hinge assembly, and as seen from the side, is shown in FIG. 6. The stile 62 has an integral flange 67*a* and a gear 65*a* displaying cogs 68. A portion of the integral flange 67*a* has been removed to reveal a recess 60*a*, which may function to aid alignment of opposing flanges when assembling and installing bi-fold door assemblies employing integral hinge mechanisms. This recess may be formed by any number of methods, for example, milling the integral flange. Alternatively, the stile and integral flange may be manufactured to incorporate said recess and further steps are not required to fashion this recess after the stile and integrated flange are manufactured. This may be accomplished, for example, by using molds. FIG. 6 shows only one recess, however, an integral flange may exhibit a number of recesses, spaced periodically along the length of the integral flange.

Figure 7:
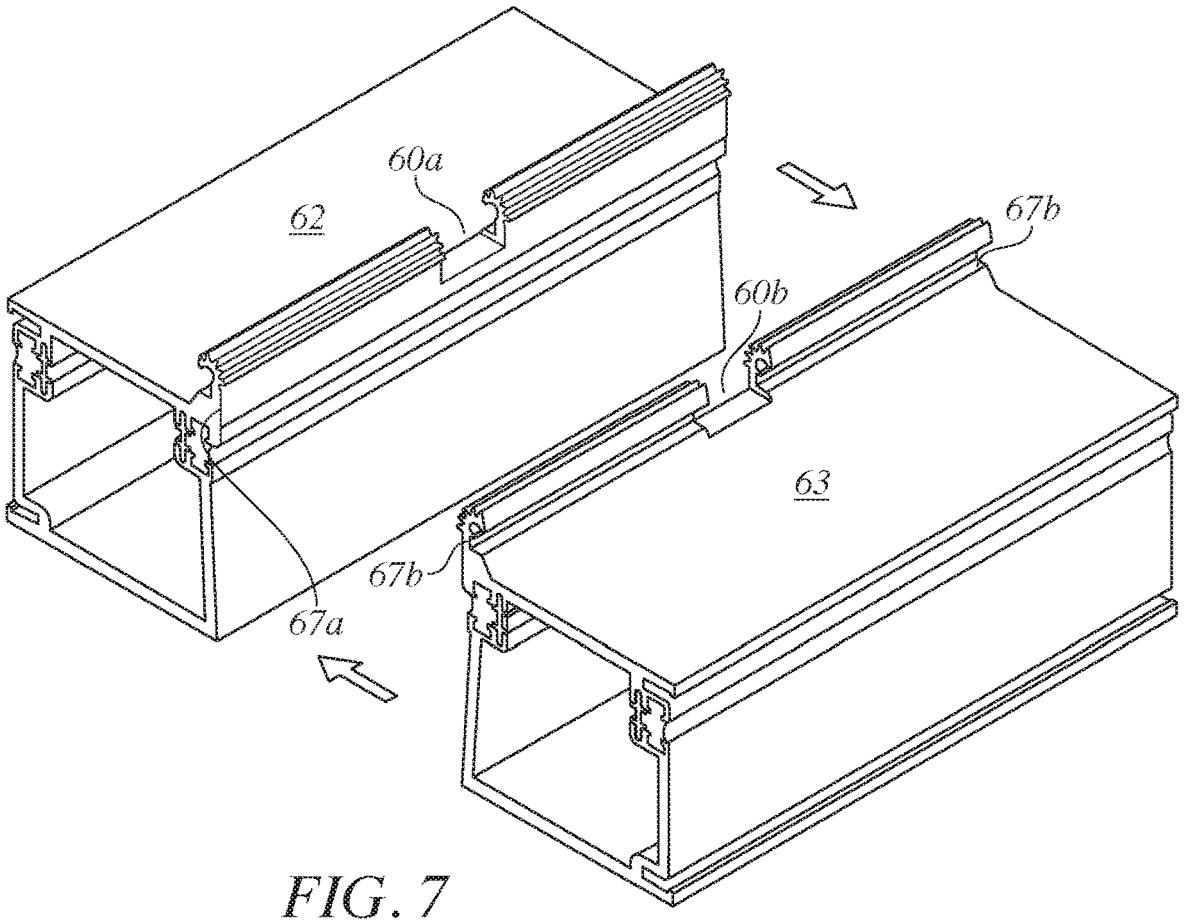
FIG. 7 illustrates a method for assembling an integral hinge assembly by joining two adjacent stiles employing integral flanges and aligning the recesses in each integral flange.

A process of assembling an integrated hinge assembly by connecting opposing stiles 62 and 63 having integral flanges 67*a* and 67*b* is illustrated in FIG. 7. During assembly, the recess 60*a* on integral flange 67*a* of stile 62 is aligned with the recess 60*b* on integral flange 67*b* of stile 63.

Figure 8:
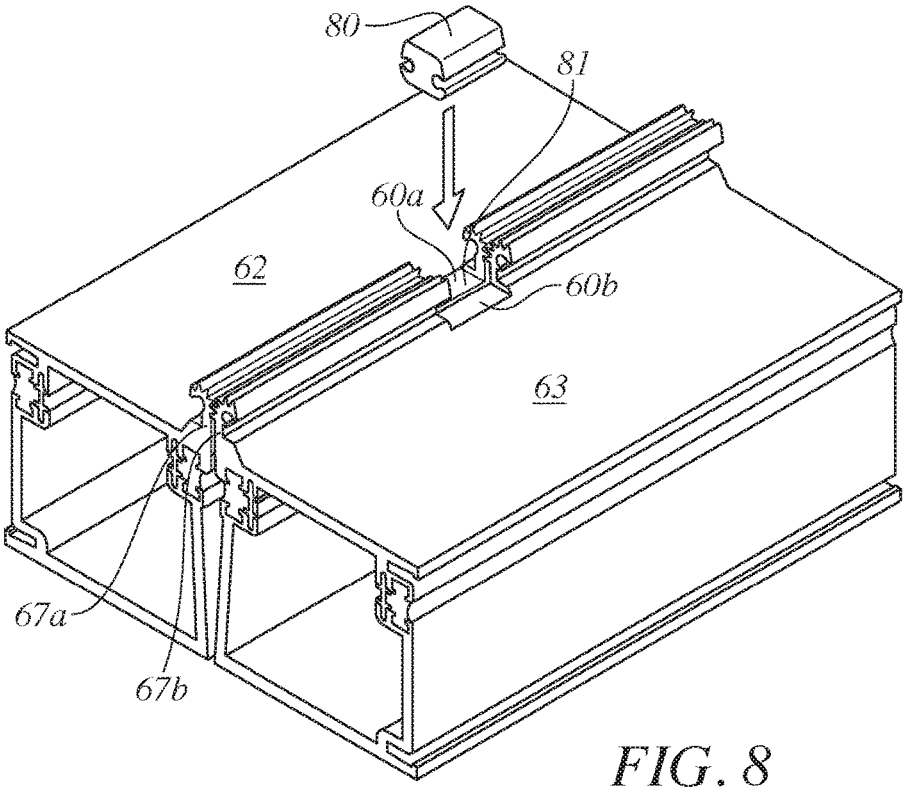
FIG. 8 illustrate insertion of a knuckle into the space created by the aligned recesses in each integral flange.

FIG. 8 illustrates the two stiles 62 and 63 of FIG. 7 aligned at recesses 60*a* and 60*b* on each integral flange 67*a* and 67*b* to define an opening 81. A knuckle 80 may be inserted into opening 81 created by recesses 60*a* and 60*b*.

Figure 9:
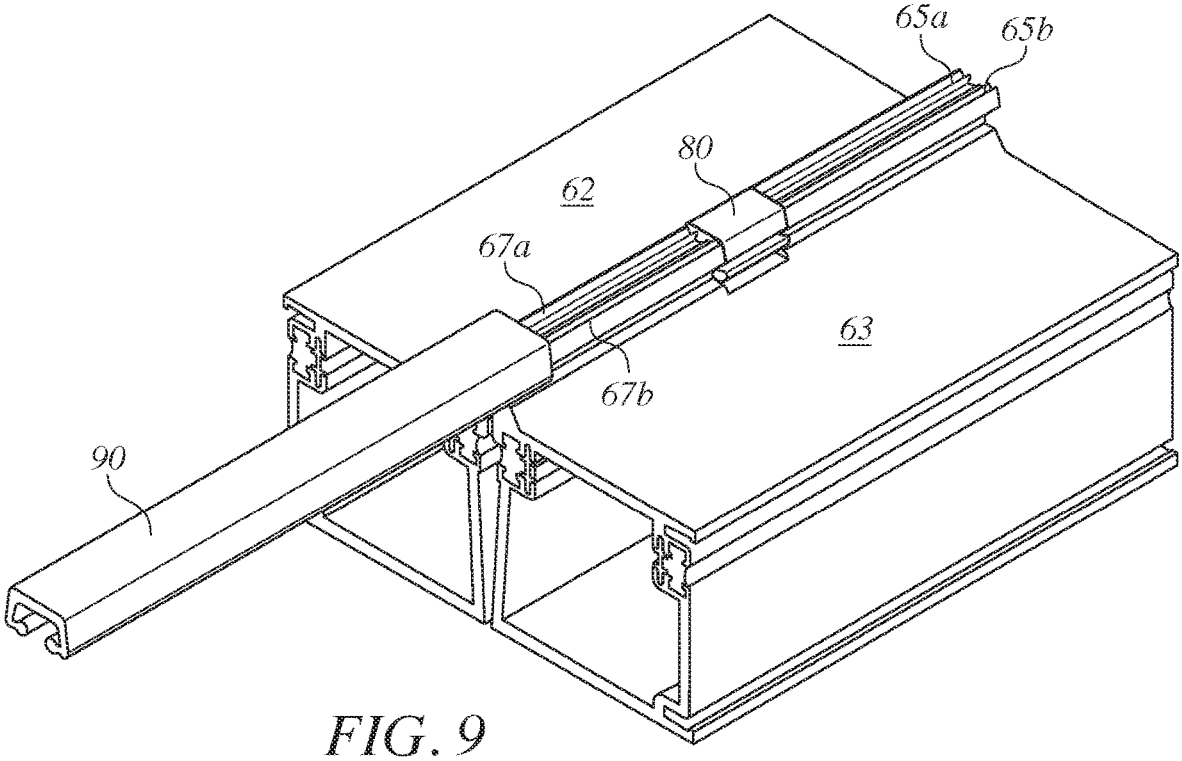
FIG. 9 illustrates attachment of a sliding gear cap over the structure created by the aligned integral flanges and the knuckle.

FIG. 9 illustrates securing the connection and the proper alignment of the integral hinge assembly by sliding gear cap 90 over the gears 65*a* and 65*b* of each integral flange 67*a* and 67*b* and over the knuckle 80. By using an integral hinge assembly that is substantially continuous (except for the recesses) along the height of each door, through the use of the knuckle to prevent longitudinal slippage of the meshed cogs, and by employing the sliding gear cap to secure all members in place, a strong and durable hinge assembly is realized that allows incorporation of thermal breaks that align with each other, thus creating maximum thermal efficiency, in bi-folding doors.

Figure 10:
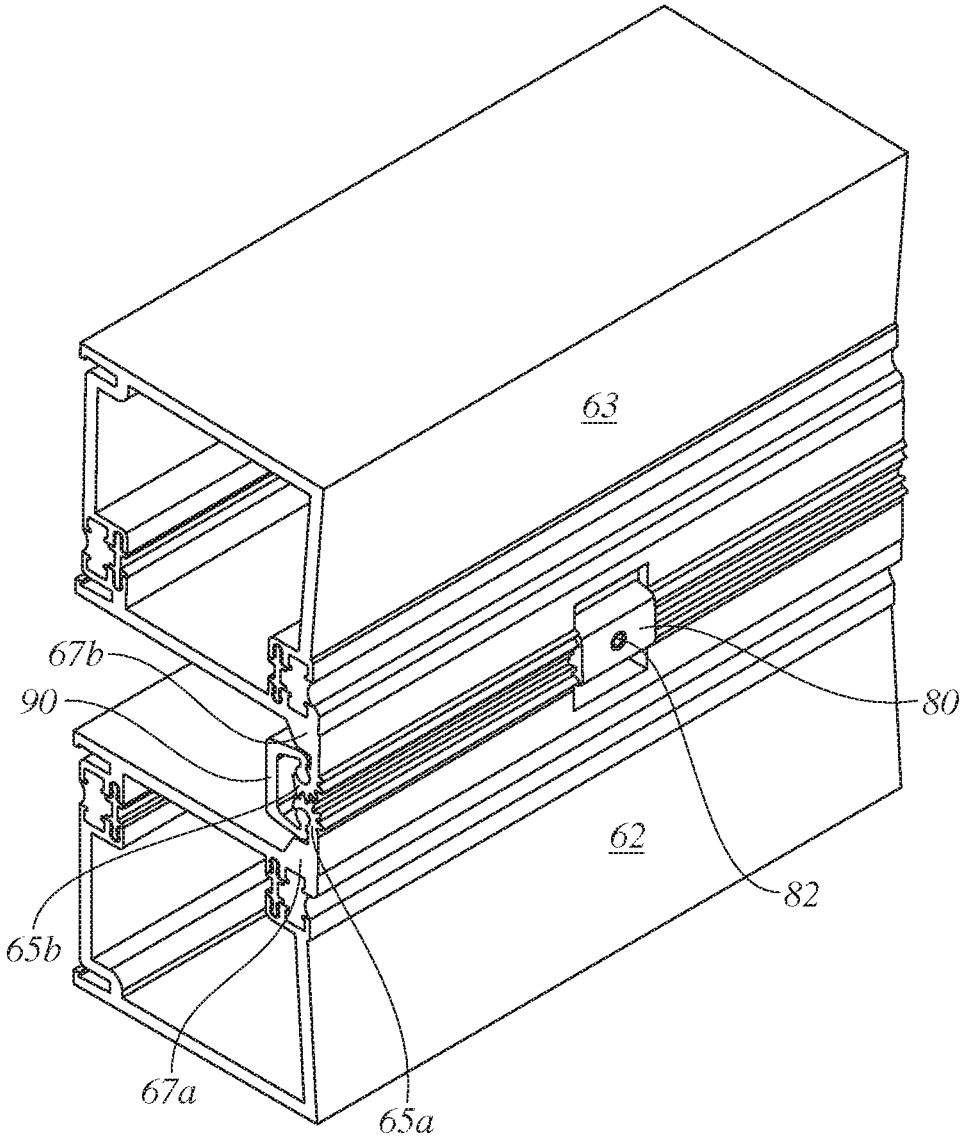
FIG. 10 illustrates two stiles joined by an integrated hinge assembly, the stiles in a folded position, wherein the cogs of each gear on each flange are interlaced, and wherein the underside of the knuckle is shown to identify a securing screw.

FIG. 10 illustrates a bi-fold door employing an integral hinge assembly with stiles 62 and 63 in an open position, when the cogs of gears 65*a* and 65*b* of each opposing integral flange 67*a* and 67*b* are interlaced with each other. This view revealing the underside of knuckle 80 and its set screw 82. The set screw 82 is tightened against the underside of gear cap 90.

Within the context of the invention, a stile and the flange which is integrated thereon may be manufactured by extrusion or pultrusion. The stile and flange may be made of any material compatible with extrusion or pultrusion processes, including aluminum. One of skill in the art of manufacturing extruded or pultruded materials would be readily able to manufacture an integral hinge assembly according to the present invention without undue experimentation.

As mentioned previously, there is an ever-growing demand for thermally efficient building materials. By employing the integral hinge assembly as described herein, thermally efficient bi-folding doors may be manufactured and implemented while retaining the structural integrity, space saving, and aesthetic qualities of a conventional bi-folding door.

Embodiments disclosed herein include:

A. A thermal folding door comprising at least two door panels each with a stile between said door panels, each stile comprising an integral hinge assembly.

B. A method of providing a hinged bi-fold door assembly includes one or more integral hinge assemblies, each integral hinge assembly comprising a first integral flange integral to a first stile and a second integral flange integral to a second stile, each flange further comprising a gear, the method the method includes aligning the first integral flange with the second integral flange such that when the first and second flange are moved around a pivot point, the cogs on the gear of the first integral flange interlace with the cogs on the gear of the second integral flange. The method further includes providing at least one recess in each integral flange at a location in each integral flange such than when the integral flanges are lined up lengthwise, the recesses in each flange line up creating at least one space along the length of the aligned integral flanges. Also inserting a knuckle in said at least one space to create a substantially continuous structure comprising the aligned first and second integral flanges and at least one knuckle may be included along with a sliding a gear cap over said substantially continuous structure; and securing said at least one knuckle in place.

C. A thermal folding door section having a top rail, a bottom rail, two stiles and a panel including a thermal break within a first stile; and an integral flange on the first stile. Each of embodiments, A, B. and C. may have one or more of the following additional elements in any combinations. Element 1: including at least one thermal break in each of said stiles. Element 2: wherein the integral hinge assembly comprises two opposing integral flanges integral to the stile. Element 3: wherein each flange further comprises a gear portion having cogs. Element 4: wherein the flanges are oriented such that arcs of the gears on each flange oppose each other. Element 5: wherein the stile and integral flange are manufactured by extrusion. Element 6: wherein the stile and integral flange are made of aluminum, titanium, steel, PVC, or fiberglass. Element 7: wherein the door panel is integral with the stile and integral flange. Element 8: wherein said at least one knuckle is secured by a set screw. Element 9: wherein said gear cap encloses the gears of each integral flange. Element 10: wherein said recesses of each integral flange are created by milling. Element 11: wherein the stile and integral flange are manufactured by extrusion or pultrusion. Element 12: wherein the stile and integral flange are made from aluminum. Element 13: further comprising a second thermal folding door section having a thermal break within a second stile and an integral flange on the second stile, wherein each flange further comprises a gear. Element 14: wherein the door panel, stile, and integral flange are manufactured by extrusion or pultrusion.

By way of non-limiting example, exemplary combinations applicable to A, B, and C include: Element 2 with Element 3; Element 2 with Element 5; Element 2 with Element 6; Element 2 with Element 7; and Element 3 with Element 4. In addition by way of non-limiting example combinations applicable to A, B and C include: Elements 1 through 7 and any combination of Elements 1 thought 7; Elements 8-12 and any combination of Elements 8-12; and Elements 13-14 and any combination of Elements 13-14.

The systems, apparatus, and methods disclosed herein are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems, apparatus, and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

Although various example embodiments have been disclosed, a worker of ordinary skill in this art would recognize that certain modifications would come within the scope of this disclosure. For that reason, the following claims should be studied to determine the scope and content of this disclosure.

The invention claimed is:

1. A thermal folding door comprising:

first, second, and third door panels;

a first integral hinge assembly interposing the first and second door panels and including:

a first stile coupled to the first door panel and integral with a first flange and a first gear;

a second stile coupled to the second door panel and integral with a second flange and a second gear;

a first thermal break coupled to the first stile; and a second thermal break coupled to the second stile and aligned with the first thermal break in a single plane; and a second integral hinge assembly interposing the second and third door panels and including:

a third stile coupled to the second door panel and integral with a third flange and a third gear;

a fourth stile coupled to the third door panel and integral with a fourth flange and a fourth gear;

a third thermal break coupled to the third stile; and a fourth thermal break coupled to the fourth stile, wherein the third and fourth thermal breaks are aligned with the first and second thermal breaks in the single plane, and wherein the first and second integral hinge assemblies alternate between an interior side and an exterior side.

2. The thermal folding door of claim 1, wherein each gear includes a gear portion having a cog, and wherein the first and second gears are oriented such that the cog of the first gear interlaces with the cog of the second gear.

3. The thermal folding door of claim 2, wherein the first and second flanges are oriented such that arcs of the first and second gears, respectively, oppose each other.

4. The thermal folding door of claim 1, wherein at least one of the first and second integral hinge assemblies is manufactured by extrusion or pultrusion.

5. The thermal folding door of claim 1, wherein the first and second integral hinge assemblies are made of a material selected from the group consisting of aluminum, titanium, steel, PVC, and fiberglass.

6. The thermal folding door of claim 1, further comprising:

a first recess defined in the first flange and the first gear;

a second recess defined in the second flange and the second gear, wherein the first and second recesses are aligned to form an opening; and a knuckle arranged within the opening.

7. The thermal folding door of claim 6, further comprising a gear cap that secures the first and second gears and covers the knuckle, wherein the first and second gears are oriented to interlace with each other.

8. The thermal folding door of claim 7, wherein the knuckle is secured to the gear cap with a set screw.

9. The thermal folding door of claim 1, wherein the first integral hinge assembly is continuous along an entire height of the first and second door panels, and wherein the second integral hinge assembly is continuous along an entire height of the second and third door panels.

10. The thermal folding door of claim 1, wherein the first thermal break comprises two first thermal breaks coupled to the first stile, and wherein the second thermal break comprises two second thermal breaks coupled to the second stile and aligned with the two first thermal breaks in the single plane.

11. A thermal folding door, comprising:

first, second, and third door panels;

a first integral hinge assembly interposing the first and second door panels and including:

a first stile coupled to the first door panel and integral with a first flange and a first gear that define a first recess;

a second stile coupled to the second door panel and integral with a second flange and a second gear that define a second recess, wherein the first and second recesses are aligned to form a first opening;

a first knuckle arranged within the opening;

a first gear cap that secures the first and second gears and covers the first knuckle;

a first thermal break coupled to the first stile; and a second thermal break coupled to the second stile and aligned with the first thermal break in a single plane; and a second integral hinge assembly interposing the second and third door panels and including:

a third stile coupled to the second door panel and integral with a third flange and a third gear that define a third recess;

a fourth stile coupled to the third door panel and integral with a fourth flange and a fourth gear that define a fourth recess, wherein the third and fourth recesses are aligned to form a second opening;

a second knuckle arranged within the second opening; and a second gear cap that secures the third and fourth gears and covers the second knuckle;

a third thermal break coupled to the third stile; and a fourth thermal break coupled to the fourth stile, wherein the third and fourth thermal breaks are aligned with the first and second thermal breaks in the single plane, wherein the first and second integral hinge assemblies alternate between an interior side and an exterior side.

12. The thermal folding door of claim 11, wherein at least one of the first and second knuckles is secured to the first and second gear caps, respectively, cap with a set screw.

13. The thermal folding door of claim 11, wherein at least one of the first and second integral hinge assemblies is manufactured by extrusion or pultrusion.

14. The thermal folding door of claim 11, wherein at least one of the first and second integral hinge assemblies is made of a material selected from the group consisting of aluminum, titanium, steel, PVC, and fiberglass.

15. The thermal folding door of claim 11, wherein the first integral hinge assembly is continuous along an entire height of the first and second door panels, and wherein the second integral hinge assembly is continuous along an entire height of the second and third door panels.

* * * * *